US008167488B2

(12) United States Patent
Giro Amigo

(10) Patent No.: US 8,167,488 B2
(45) Date of Patent: May 1, 2012

(54) BAG FOR PACKAGING FOOD PRODUCTS

(75) Inventor: Ezequiel Giro Amigo, Badalona (ES)

(73) Assignee: Girnet Internacional, S.L., Badalona (ES)

( * ) Notice: Subject to any disclaimer, the term of this patent is extended or adjusted under 35 U.S.C. 154(b) by 1001 days.

(21) Appl. No.: 12/114,270

(22) Filed: May 2, 2008

(65) Prior Publication Data

US 2008/0273817 A1 Nov. 6, 2008

(30) Foreign Application Priority Data

May 4, 2007 (ES) ..... 200701187

(51) Int. Cl.
*B65D 33/06* (2006.01)
*B65D 33/14* (2006.01)
*B65D 30/04* (2006.01)
*B65D 30/06* (2006.01)

(52) U.S. Cl. ..... 383/21; 383/6; 383/22; 383/117

(58) Field of Classification Search ..... 383/6, 7, 383/10, 12, 15, 16, 21, 22, 24, 25, 29, 41, 383/117; 224/258, 578, 580, 663; 206/315.9; 105/107
See application file for complete search history.

(56) References Cited

U.S. PATENT DOCUMENTS

| | | | | | |
|---|---|---|---|---|---|
| 4,090,897 | A | * | 5/1978 | Minick | 156/73.1 |
| 4,373,979 | A | * | 2/1983 | Planeta | 156/73.1 |
| 4,403,637 | A | | 9/1983 | Rivelles Sabater et al. | |
| 4,753,538 | A | * | 6/1988 | Jorda | 383/8 |
| 5,192,133 | A | * | 3/1993 | Juel et al. | 383/7 |
| 5,836,695 | A | * | 11/1998 | Hanson | 383/14 |
| 6,088,999 | A | * | 7/2000 | Olaechea | 53/417 |
| RE36,876 | E | * | 9/2000 | Daniels et al. | 383/8 |
| 6,205,747 | B1 | * | 3/2001 | Paniagua Olaechea | 53/417 |
| 6,237,533 | B1 | * | 5/2001 | Rodriguez | 119/161 |

FOREIGN PATENT DOCUMENTS

| | | | |
|---|---|---|---|
| EP | 0 047 544 | A1 | 3/1982 |
| EP | 0 677 449 | A1 | 10/1995 |
| ES | 0 172 093 | U | 2/1972 |
| ES | 0 207 717 | U | 3/1976 |
| ES | 1 027 615 | U | 9/1994 |
| ES | 1 027 802 | U | 10/1994 |
| ES | 0 220 757 | U | 1/1995 |
| ES | 2 169 787 | T3 | 2/1998 |
| ES | 1 050 533 | U | 4/2002 |

OTHER PUBLICATIONS

European Search Report for EP 08 38 0082, dated Jul. 31, 2008.
European Search Report for EP 09 16 9673, dated Oct. 13, 2009.
Spanish Search Report for ES 200701187, dated Oct. 8, 2009.

* cited by examiner

*Primary Examiner* — Nathan J Newhouse
*Assistant Examiner* — Nina Attel
(74) *Attorney, Agent, or Firm* — Sughrue Mion, PLLC

(57) ABSTRACT

Bag for packaging food products, particularly fruit and vegetable products, which comprises a flexible tubular body, the central portion of which is designed to house the products contained in the bag and the longitudinal ends of which are closed, a flexible oblong element, such as a strip, which is considerably shorter than the tubular body of the bag, being solidly joined to both closed ends, which acts as a handle whereby to suspend said bag, the tubular body being overdimensioned in relation to the volume of the products housed therein, so that when the bag is suspended from the strip that acts as a handle, it is U-shaped, with its end portions empty and in a vertical position and with its central portion filled with products.

28 Claims, 2 Drawing Sheets

BAG FOR PACKAGING FOOD PRODUCTS

TECHNICAL FIELD OF THE INVENTION

The present invention relates to a bag for packaging food products, which is particularly applicable to the packaging of fruit and vegetable products, such as citrus fruit or root vegetables.

BACKGROUND OF THE INVENTION

There are many known embodiments of bags for packaging and marketing food products. Particularly well known are breathable bags designed for packaging and marketing fruit and vegetable products such as citrus fruit, root vegetables and suchlike. These bags, unlike conventional plastic bags, allow the product to breathe, lengthening its storage time and enabling the buyer to inspect the appearance, touch and smell of their contents.

These bags are normally manufactured from a continuous tubular element, made from a flexible and preferably heat-sealable material, generally in the form of mesh, cut transversally to form portions of tubular mesh.

During the packaging process of the product, the mouths at each end of these portions of tubular mesh are closed separately by staples or welding. To close the mouths at each end of the portions of tubular mesh by heat sealing, they are conventionally provided with strips of a heat-sealable material in pairs, applied to respective sides of the tubular mesh at each end thereof, which are subsequently joined by heat sealing, the end portion of the tubular mesh being partially melted and embedded between the two strips of the same pair. In some variants of bags, the strips applied to the opposite ends of the same side of the tubular mesh are continuously joined and optionally fastened by points to the corresponding side of the tubular mesh.

This operation requires the use of sufficient heat from outside to melt the material that constitutes the inner face of the strips and the tubular mesh, the products contained in the bag then being closed therein without it being possible to remove them unless the bag is broken.

It should be stated that the aforementioned continuous tubular mesh is occasionally made from a flat mesh, the longitudinal edges of which are joined to form the continuous tubular mesh.

Spanish utility model No. U1050533 discloses a bag like those described above, the mouths at the ends of which have been closed by heat sealing the strips of heat-sealable material. In the bag disclosed therein one of the strips has been cut at each end, the central portion of said strip having been removed. The remainder of the strip, the ends of which are firmly secured at respective ends of the bag and solidly fastened thereto by heat-sealed points, determines a handle whereby to hold the bag.

The object of utility model No. U9401000 presents, among others, the drawback that, when the bag is completely filled with objects, the handle is in a tight position very close to the surface of the bag, which makes it difficult to hold and use.

Furthermore, it has been seen that in bags with a large capacity, where the strip is of a similar length to the bag, the relatively long length of the bag and the strip make the bag difficult to transport when it is suspended from the handle, as the width of the bag is not significantly reduced and it is at too low a height, hanging at knee-level or below the knees, so that when the bag rotates slightly it can easily knock the user's legs.

EXPLANATION OF THE INVENTION

Essentially, the bag for packaging food products that is the object of the present invention is characterised in that, being of the type that comprises a flexible tubular body, the longitudinal ends of which are closed and fastened to the respective ends of a flexible oblong element that acts as a handle, said oblong element is considerably shorter than the tubular body of the bag; and in that the tubular body is longitudinally overdimensioned in relation to the volume of the products housed therein, so that when it is suspended from the oblong element that acts as a handle, it is U-shaped, with its end sections empty and in a vertical position and with its central portion filled with products.

According to another characteristic of the invention, the oblong element that acts as a handle whereby to suspend the bag is shorter than half of the length of the tubular body of the bag, and it has a maximum width of 30 mm.

Preferably, said oblong element is a laminar strip that is adapted to carry printed information.

According to another characteristic of the invention, the bag is provided with a second oblong element, which is also solidly joined to both closed ends of the tubular body, of a considerably shorter length than that of the oblong element that acts as a handle whereby to suspend the bag.

In a preferred embodiment, said second oblong element is a second flexible laminar strip.

According to another characteristic of the invention, the end portions of said second strip are considerably narrower than the central portion.

According to another characteristic of the invention, the central portion of the second strip is adapted to carry printed information.

According to another characteristic of the invention, the tubular body consists of a woven or extruded tubular mesh.

According to another characteristic of the invention, the oblong element that acts as a handle and the second oblong element, where applicable, are solidly joined to both longitudinal ends of the tubular body by welding.

According to another characteristic of the invention, the welding is carried out by applying ultrasound.

According to another characteristic of the invention, the oblong element that acts as a handle and the second oblong element, if applicable, are solidly joined to both longitudinal ends of the tubular body by stapling.

According to another characteristic of the invention, the end sections of the tubular mesh that constitutes the tubular body, the longitudinal ends of which are solidly joined to the oblong element that acts as a handle and to the second oblong element, if applicable, are gathered in the area of the joint with or without a particular order.

BRIEF DESCRIPTION OF THE DRAWINGS

In the attached drawings an embodiment of the bag that is the object of the invention is illustrated by means of a non-limiting example. In said drawings.

DETAILED DESCRIPTION OF THE DRAWINGS

Figure 1:
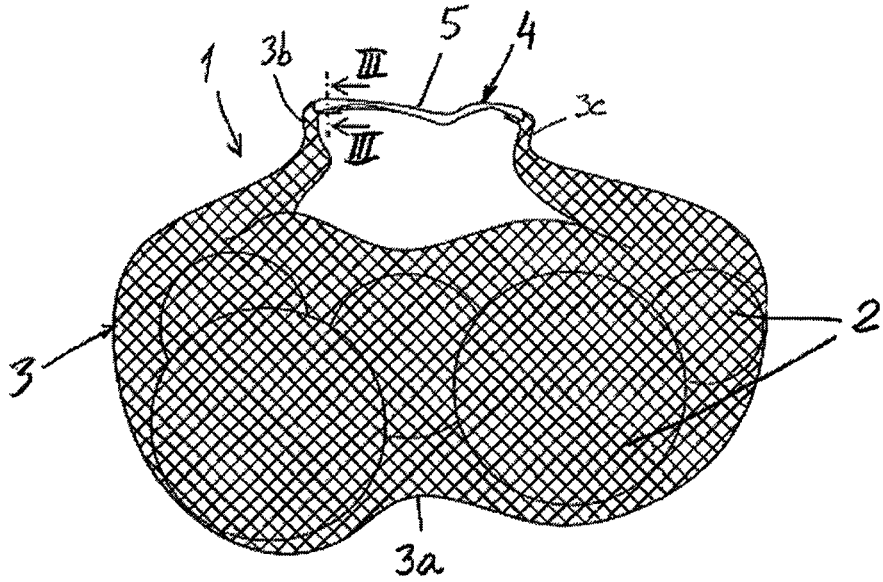
FIG. 1 shows a perspective view of a bag according to the invention, filled and with only one first oblong element as a handle.
Figure 2:
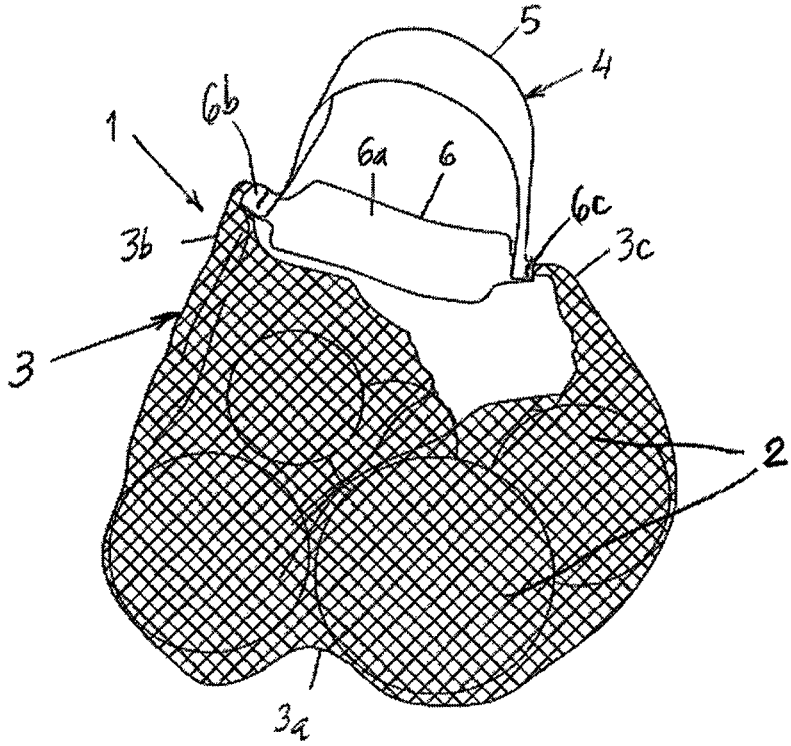
FIG. 2 is a similar view to that shown in FIG. 1, of a bag with two flexible oblong elements.

In FIGS. 1 and 2 it can be seen that the bag 1 for packaging products 2 comprises a tubular body 3, preferably made from a flexible mesh, the central portion 3*a* of which is designed to contain the products 2 contained in the bag 1.

The longitudinal ends 3*b*, 3*c* of the mesh are closed, solidly joined to which are the ends of at least a first oblong element 4, shown as a flexible strip, which acts as a handle 5 whereby to suspend the bag 1.

The flexible strip that constitutes the handle 5 in the examples in FIGS. 1 and 2 is laminar and is shorter than half of the length of the tubular body 3, so that when the bag is resting on a surface it adopts a position similar to that shown in FIG. 1. Said flexible strip has a maximum width of 30 mm and is adapted to contain printed information about the products 2 contained in the bag 1.

As regards the length of the oblong element 4, it is between approximately 10 cm and approximately 25 cm long, which results in a length that is considerably shorter than the length of conventional bags.

The invention also contemplates equivalent variants for the oblong element 4, which can also act as a handle 5, such as, in addition to the flexible strip shown herein, a cord, a string, a cable, a tape, a strap, a tubular element, an element wound around itself e.g. made from mesh, twine, etc., made from fabric, plastic, metal wire, leather or another material that can support the weight of the full bag 1.

Returning to the example shown in FIGS. 1 and 2, in order to keep the flexible strip that acts as a handle upright even when the bag 1 is resting on the surface of a counter, a shelf or suchlike, a second oblong element 6 is provided between the end portions 3*b* and 3*c*, consisting of a second flexible laminar strip, as shown in the example in FIG. 2, preferably adapted to receive printed information, of a considerably shorter length than the oblong element 4 that acts as a handle 5. As is shown in FIG. 2, this second laminar strip prevents the end portions 3*b* and 3*c* of the tubular body 3 from separating and ensures that the flexible strip that acts as a handle 5, which is strong enough, is not taut and remains upright in a curved shape, thus making it easier for the user to take hold of.

In the case of this example, wherein the oblong element 4 consists of a strip, if it is not designed to be used as a support for printed information or when the necessary printed information does not fit on this strip or cannot be applied to said strip as it creases when used as a handle 5, a second flexible laminar strip as a second oblong element 6 can act as a support for a self-adhesive label or can be printed on directly. For this purpose, the central portion 6*a* of this second laminar strip can be considerably wider than its end portions 6*b*, 6*c*, as shown in FIG. 2.

Unlike known bags, the bag 1 of the invention is overdimensioned, in relation to the volume of products 2 housed therein, so that when it is suspended from the handle 5, the bag is visibly U-shaped, with its end portions 3*b*, 3*c* empty and in a vertical position and with its central portion 3*a* filled with products 2. If the bag were completely filled, it could not adopt the preferred form shown in FIGS. 1 and 2.

The solid joint between the end portions 3*b* and 3*c* of the tubular mesh and the corresponding ends of the oblong elements 4 and 6 can be created using conventional methods, by heat sealing or by stapling.

If the tubular body 3 consists of a woven tubular mesh, made from a material that is woven to form a mesh with wide openings with plastic filaments that are strong enough to support the planned weight of the product 2, or an extruded mesh wherein the tubular mesh is produced by extrusion and expansion of a continuous laminar element made from a plastic material that is subsequently provided with multiple openings, which after a stretching or extending process is transformed into a mesh with a similar appearance to that of a woven mesh, the heat sealing operation can be carried out by ultrasound.

To do this, the two longitudinal end portions 3*b* and 3*c* are gathered in the area where they are joined to the oblong element 4, or both oblong elements 4 and 6, if applicable, gathered randomly or folded, preferably along longitudinal folds, and are applied to the ends of said oblong elements 4 and 6, which if consisting of laminar strips can partially (see FIG. 3) or fully surround said end portions 3*b* and 3*c*. The material of the mesh and part of the laminar strips are melted by applying ultrasound.

Figure 3:
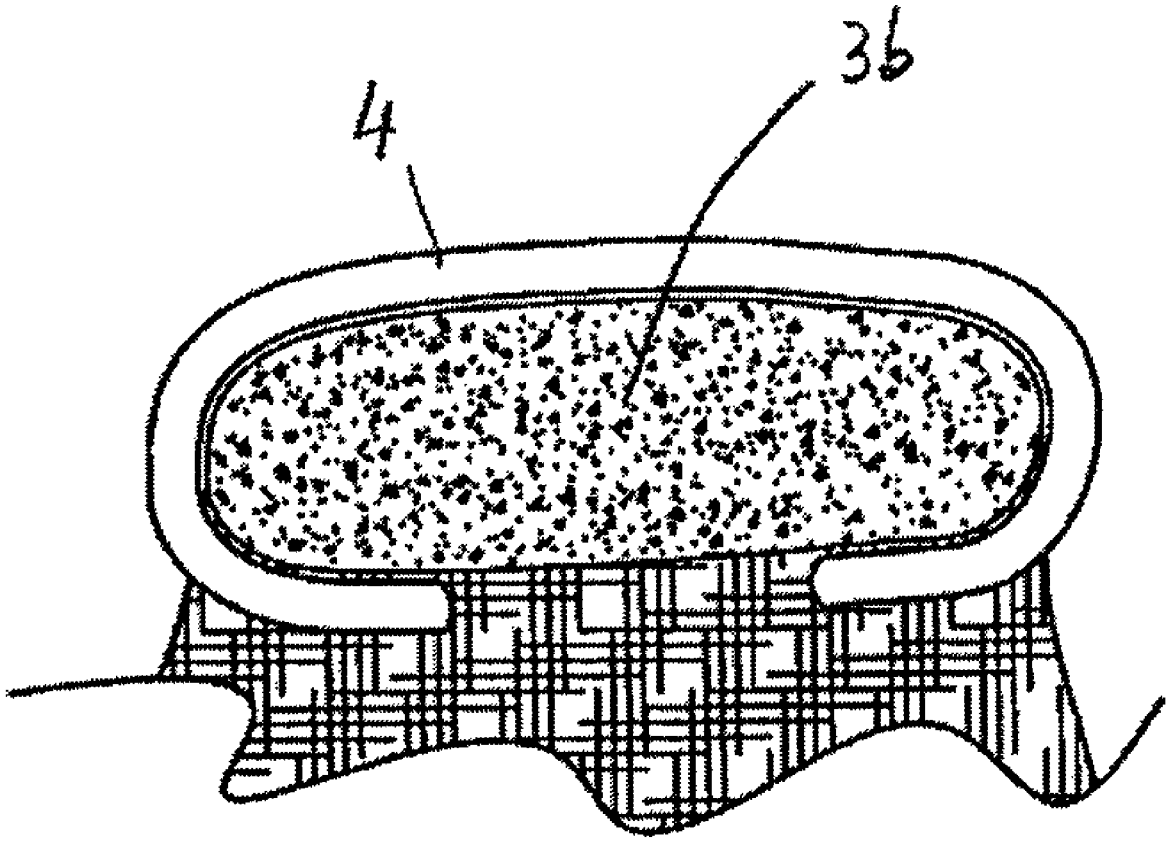
FIG. 3 shows a larger-scale cross-sectional view, taken along III-III of FIG. 1.

FIG. 3 schematically shows a cross section of the area where the oblong element 4 consisting of a flexible strip and the longitudinal end 3*b* of the bag 1 of FIG. 1 are joined. In this FIG. 3 the thicknesses of the portion of gathered mesh and the strip have been exaggerated to make it easier to understand.

The invention claimed is:

1. A bag for packaging food products, which comprises a flexible tubular body, a central portion of which is designed to house the products contained in the bag and the longitudinal ends of which are closed, a flexible oblong element solidly joined to both closed ends; and which is a handle whereby to suspend the bag; the tubular body, when empty and prior to joining the oblong element to the tubular body, defines a length $L_T$ between longitudinal ends of the tubular body; the oblong element defines a fixed length $L_O$ between longitudinal ends of the oblong element; the length $L_O$ is shorter than $L_T$; and the tubular body is longitudinally overdimensioned in relation to the volume of products housed therein, so that when suspended from the oblong element the tubular body is U-shaped, with end portions of the tubular body empty and in a vertical position and with the central portion of the tubular body filled with products.

2. The bag for packaging food products according to claim 1, wherein the oblong element is a laminar strip and is adapted to carry printed information.

3. The bag according to claim 1 configured to contain fruit and vegetable products.

4. The bag according to claim 1, comprising at least one of fruit and vegetable products.

5. The bag according to claim 1, wherein the flexible oblong element is a strip.

6. The bag for packaging food products according to claim 1, wherein the oblong element is shorter than half of the length of the tubular body of the bag and has a maximum width of 30 mm.

7. The bag for packaging food products according to claim 6, comprising a second oblong element which is also solidly joined to both closed ends of the tubular body and is shorter than the oblong element that is the handle.

8. The bag for packaging food products according to claim 1, comprising a second oblong element which is also solidly joined to both closed ends of the tubular body and is shorter than the oblong element that is the handle.

9. The bag for packaging food products according to claim 8, wherein the second oblong element is a second flexible laminar strip.

10. The bag for packaging food products according to claim 9, wherein end portions of said second oblong element are narrower than a central portion between the end portions.

11. The bag for packaging products according to claim 10, wherein the central portion of the second oblong element is adapted to carry printed information.

12. The bag according to claim 8, wherein the flexible oblong element that is the handle and the second oblong element are solidly joined to both longitudinal ends of the tubular body by welding.

13. The bag according to claim 12, wherein the end sections of the tubular mesh that constitutes the tubular body, the longitudinal ends of which are solidly joined to the flexible oblong element that is the handle, are gathered in the area of the joint with or without a particular order.

14. The bag according to claim 8, wherein the flexible oblong element that is the handle and the second oblong element are solidly joined to both longitudinal ends of the tubular body by stapling.

15. The bag according to claim 14, wherein the end sections of the tubular mesh that constitutes the tubular body, the longitudinal ends of which are solidly joined to the flexible oblong element that is the handle, are gathered in the area of the joint with or without a particular order.

16. The bag according to claim 8, wherein the second oblong element is a strip.

17. The bag according to claim 1, wherein the tubular body is made from a woven or extruded tubular mesh.

18. The bag according to claim 17, wherein the flexible oblong element that is the handle is solidly joined to both longitudinal ends of the tubular body by welding.

19. The bag according to claim 17, wherein the flexible oblong element that is the handle is solidly joined to both longitudinal ends of the tubular body by stapling.

20. The bag according to claim 18, wherein the welding is carried out by applying ultrasound.

21. The bag according to claim 18, wherein end sections of the tubular mesh that constitutes the tubular body, the longitudinal ends of which are solidly joined to the flexible oblong element that is the handle, are gathered in the area of the joint with or without a particular order.

22. A bag for packaging food products, comprising: a flexible tubular body having a central portion configured to house the products contained in the bag and having longitudinal ends; a flexible element that is elongated and joined to both longitudinal ends to form a handle for the bag; the flexible tubular body, when empty and prior to joining the flexible element to the tubular body, defines a length $L_T$ between the longitudinal ends of the tubular body; the flexible element defines a fixed length $L_O$ between longitudinal ends of the flexible element; the length $L_O$ is shorter than $L_T$, so that when the bag contains products and is suspended from the flexible element, the flexible element forms the handle with the tubular body in a general U-shape with end portions of that tubular body empty of product and in a generally vertical orientation and with the central portion of the tubular body filled with the products.

23. The bag according to claim 22, comprising a second elongate element solidly joined to both longitudinal ends of the tubular body and shorter than the elongated element that forms the handle.

24. The bag according to claim 22, comprising at least one of fruit and vegetable products.

25. The bag according to claim 22, sealed and contained with product so that when suspended from the flexible element, the flexible element forms the handle with the tubular body in a general U-shape with end portions of the tubular body empty of product and in a generally vertical orientation and with the central portion of the tubular body filled with the products.

26. The bag according to claim 25, wherein the products are fruits or vegetables.

27. The bag according to claim 25, wherein the length $L_O$ is less than half the length $L_T$.

28. The bag according to claim 27, wherein the flexible element has a maximum width of less than 30 mm.

* * * * *